United States Patent [19]

Kojima et al.

[11] 3,940,721

[45] Feb. 24, 1976

[54] CAVITY RESONATOR HAVING A VARIABLE RESONANT FREQUENCY

[75] Inventors: Yasuaki Kojima; Takayoshi Shinozaki; Akira Takahashi, all of Tokyo, Japan

[73] Assignee: Nippon Electric Company, Ltd., Tokyo, Japan

[22] Filed: Apr. 29, 1975

[21] Appl. No.: 572,730

[30] Foreign Application Priority Data

May 9, 1974 Japan ..... 49-53078

[52] U.S. Cl. ..... 333/83 R; 315/5.46; 315/5.48

[51] Int. Cl.[2] ..... H01P 7/06

[58] Field of Search..... 333/83 R; 315/5.21, 5.22, 315/5.46, 5.47, 5.48, 5.53, 5.54; 220/22.4, 319

[56] References Cited

UNITED STATES PATENTS 3,078,385 2/1963 Sorg et al..... 315/5.48

3,278,795 10/1966 Mihran ..... 315/5.46

*Primary Examiner*—Paul L. Gensler

*Attorney, Agent, or Firm*—Ostrolenk, Faber, Gerb & Soffen

[57] ABSTRACT

A cavity resonator having adjustably tunable resonant frequency in which tuning of the resonant frequency is carried out by means of a movable side plate, characterized in that contactor pieces supported by the edges of said movable side plate for realizing high frequency short-circuiting to a cavity wall, consist of metallic wires, each of which is wound in a coil shape preferably having a diameter that is no greater than the distance between the opposite side plate edges in which the coils are mounted.

4 Claims, 8 Drawing Figures

PRIOR ART

PRIOR ART

CAVITY RESONATOR HAVING A VARIABLE RESONANT FREQUENCY

BACKGROUND OF THE INVENTION

This invention relates to a cavity resonator having an adjustably tunable resonant frequency, and is especially suitable for use as a cavity resonator in a multi-cavity type klystron. A multi-cavity klystron widely in use as a final stage amplifier tube in various types of transmitters, especially in a high power transmitter, generally has a tuning frequency range of several percent to several tens of percent of the particular midfrequency value.

Tuning systems for cavity resonators are largely classified into three types, one being a system of varying principally an inductance by movement of a side wall of the cavity (abbreviated as L-tuning), another being a system of varying principally a capacitance of the cavity by moving a tuning plate provided in the vicinity of a gap space between drift tubes within the cavity (C-tuning), and the other being a system which combines the aforementioned two systems (L/C-tuning).

These three tuning systems have their respective advantageous features, and they are selectively employed in accordance with needs of the particular application. However, it is said that generally the L-tuning system is a system that is stable in performance.

BRIEF DESCRIPTION OF THE INVENTION

The present invention is characterized by providing a side plate in which grooves are formed in selected edges of the cavity resonator movable side plate for receiving and supporting coiled metallic wires which are adapted to make sliding engagement and good electrical contact with adjacent interior surfaces of the cavity wall to permit relatively simple adjustment of the cavity resonator operating frequency while at the same time assuring excellent electrical contact with the cavity walls and with the movable side plate. The coiled metallic wires are preferably made of a material which is highly stable and durable under operating conditions in which the cavity resonators generate a large amount of heat.

DETAILED DESCRIPTION OF THE INVENTION

Figure 1A:
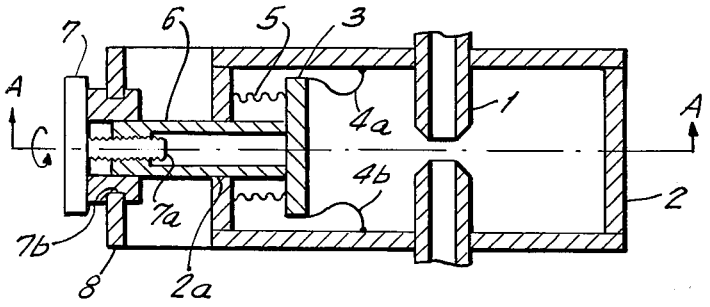
FIG. 1a. PRIOR ART
FIGS. 1*a* and 1*b* are views showing a cavity resonator in an internal cavity type klystron provided with a diaphragm type resonant frequency varying means, FIG. 1*a* being a longitudinal cross-section view taken along the direction of the beam axis of said klystron, and FIG. 1*b* being a transverse cross-section view taken along line A—A in FIG. 1*a*.
Figure 1B:
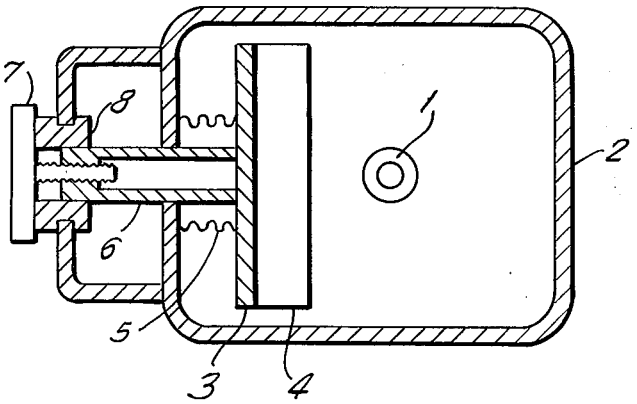
FIG. 1b. PRIOR ART

Now a description will be given with reference to the drawings. FIGS. 1a and 1b show a cavity resonator in an internal cavity type klystron as one example of a cavity resonator in which a movable cavity side wall is utilized for tuning purposes. The cavity resonator in FIGS. 1*a* and 1*b* comprises drift tubes 1 for passing an electron beam therethrough, a vacuum envelope 2 forming an external wall of the cavity, an induction plate 3 forming one side wall of the cavity, diaphragms 4*a* and 4*b* each made of a flexible metal plate and each having one end respectively fixedly secured to the induction plate 3. A bellows 5 allows the induction plate to move while maintaining a vacuum in the cavity (by sealing the opening 2*a*).

To the induction plate 3 is fixedly secured a stem 6, and by rotating a knob assembly comprised of a manually operable knob 7, coupled to an external tuning screw 7*a*, the stem and the induction plate are jointly moved back and forth, and thereby the volume of the cavity resonator can be varied to change the resonant frequency. The side wall 8 has a groove 7*b* which receives the marginal portion of wall 8 so as to freewheelingly mount knob assembly 7 relative to wall 8. With regard to the cavity resonator shown in FIGS. 1*a* and 1*b*, firstly the movable range of the induction plate 3 is limited by the extended length of the diaphragms 4*a* and 4*b* as measured in the direction of flexure, and the diaphragms cannot be made too long since they are made of a thin flexible metal plate, so that the cavity resonator in FIGS. 1*a* and 1*b* has a disadvantage in that the frequency tuning range cannot be made large. In addition, since the diaphragms are made of a thin metal plate, they are mechanically and thermally weak, which presents problems when used in resonators having high power ratings. Furthermore, when the induction plate moves to a position where the flexure of the diaphragm 4 is large, the shape of the cavity becomes irregular, so that abnormal modes are generated, which may adversely affect the desired operating mode to produce oscillation phenomena and which may cause sparking and the like.

Figure 2:
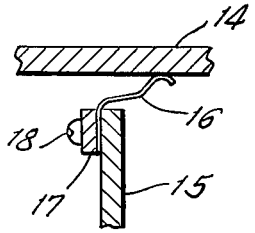
FIG. 2 is a fragmentary cross-section view showing a contact structure between a movable side plate and a cavity wall according to a spring finger system.

With regard to another structure in which a side plate is moved while short-circuiting a high frequency between the movable side plate and the external cavity wall instead of using said diaphragms, there exists a spring finger system which has been practically used in an external cavity type of UHF klystron. The structure is shown in FIG. 2. A spring finger 16 made of a flexible metallic material such as beryllium copper is secured to movable side plate 15 by means of a clamp plate 17. Fastening means, such as screws 18 are utilized to secure both the spring finger 16 and the clamp plate 17 to side plate 15. The structure is such that, owing to the spring action of spring finger 16, the side plate 15 can be moved while sliding contact of spring finger 16 is continuously maintained with the inner surface of the external cavity wall. Though this system presents no problem in the case where the cavity resonator is of the external cavity type and the cavity is large as in the case of that used in a UHF band, nevertheless, in the case of an internal cavity type there is an exhausting process utilized in the manufacture of a vacuum tube and during this process the cavity is heated for a long period of time at a high temperature such as 400° – 600°C. Beryllium copper has most excellent properties for use as a spring finger and which in fact is widely used for such purposes. However, the resiliency of the material tends to deteriorate when the spring is subjected to such a high-temperature baking process. Also, in the case of a klystron working at a high frequency of several GHz or higher, the cavity resonator becomes very small in size, so that the spring finger system presents many structural problems.

Figure 3A:
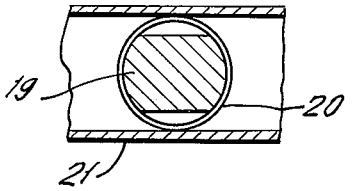
FIG. 3a. PRIOR ART
FIG. 3*a* is a fragmentary cross-section view showing a contact structure of a single coil system.
Figure 3B:
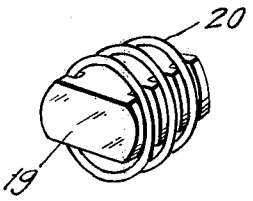
FIG. 3*b* is a perspective view of a coil body.

In addition to the above approaches, in the case of a klystron working in a 6GHz band, a spring coil system employing a single coil having a diameter substantially equal to the distance between the opposed side walls of the cavity, has been known. One such structure is shown in FIGS. 3a and 3b.

Around a movable side plate 19 is wound a coil 20 which is designed to make sliding contact with the upper and lower interior surfaces of an external cavity wall 21. The coil 20 is made of a metallic wire such as tungsten and the like to provide a coil having an elasticity and a good electrical conductivity and to allow the side plate 19 to move in a linear fashion in order to vary the cavity resonant frequency while always maintaining good sliding contact with the inner surfaces of the external cavity wall 21. According to this system, as the height of the cavity resonator increases, the outer diameter of the coil 20 accordingly becomes quite large, so that the movement of the individual turns of the coil would become quite unstable, resulting in electrically unstable phenomena due to contact between the respective rings, and also problems would arise in respect to structural integrity of the assembly.

The present invention provides a cavity resonator provided with a novel high frequency short-circuiting structure for the movable side plate which is free from all of the above-described problems.

Figure 4A:
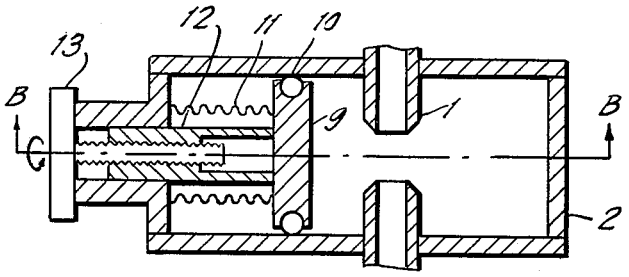
FIG. 4*a* is a longitudinal cross-section view taken along the direction of the beam axis of a cavity resonator in an internal cavity type of klystron embodying the present invention.
Figure 4B:
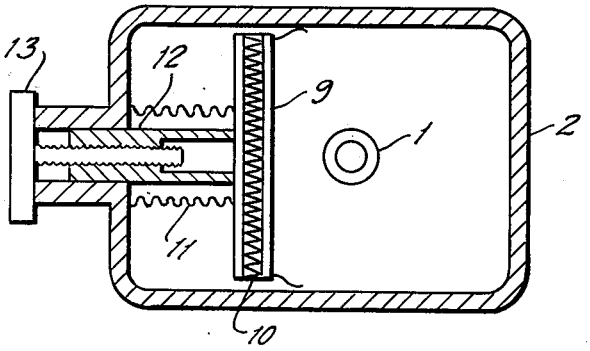
FIG. 4*b* is a transverse cross-section view (the movable side plate being shown with its end surface) taken along line B—B in FIG. 4*a*.

FIGS. 4*a* and 4*b* show a cavity resonator according to the present invention as applied to an internal cavity type klystron. The cavity resonator in FIGS. 4*a* and 4*b* comprises drift tubes 1 for passing an electron beam therethrough, a vacuum envelope 2 forming an outer wall of the cavity, a movable side plate 9 for forming one side wall of the cavity, metallic wires 10 made of tungsten and the like and wound in a coil shape of such size that the coils may be fitted within grooves provided along the upper and lower edges 9*a* and 9*b* of said movable side plate (FIG. 5) and may be received in the gap spaces formed between the upper and lower edges of the side plate and upper and lower interior walls of the cavity in the fully assembled state. Bellows 11 enables the movable side plate to undergo linear movement while maintaining a vacuum condition within the cavity. To the movable side plate 9 is fixedly secured a stem 12, and by rotating an external operating knob tuning screw 13, the stem and the movable side plate are jointly moved back and forth, and thereby the volume of the cavity resonator can be varied to change the resonant frequency.

Figure 5:
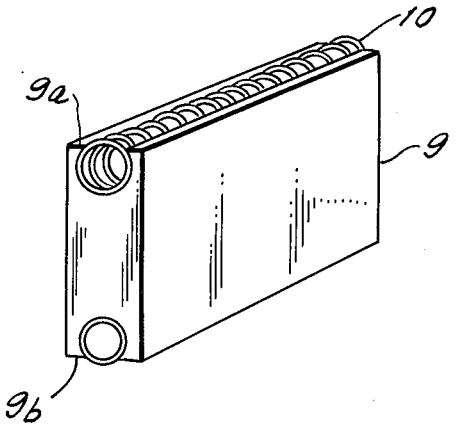
FIG. 5 is a perspective view of the movable side plate shown in FIGS. 4*a* and 4*b*.

FIG. 5 is a detailed illustration of the movable side plate 9 and the coiled metallic wires 10 in the cavity resonator according to the present invention as shown in FIGS. 4*a* and 4*b*. The metallic wire coils 10 are preferably made of a material that is durable and stable at a high temperature and that has a considerably good electrical conductivity and elasticity such as, for example, tungsten. Preferably, the outer diameters of the coils are smaller than one-half the distance between the opposed edges 9*a* and 9*b* of the side plate which respectively support said coils, because the outer circumference of the coil is in itself fitted between the side plate and the side wall of the cavity, and also the coils are wound in such density that high frequency energy may not leak out therethrough. With regard to the method for fixedly mounting said coil on the movable side plate, in FIG. 5 the positioning and fixing of the coil are achieved through a very simple and reliable method of notching grooves having a crosssection of more than one-half circle along the upper and lower edges and fitting the coils in these notched grooves. In case that such movable side plate combined with coils is inserted into the interior of the cavity, it will be moved within the cavity while always maintaining a fixed contact pressure for varying the resonant frequency, if the various parts are manufactured with appropriate dimensions. In this structure, the movable range of the movable side plate is limited only by the range of expansion and contraction of the bellows, so that the tuning range can be selected very wide, and also, leakage of a high frequency energy is almost zero, thermally unstable phenomena caused by a high frequency current would not occur at all, and therefore, this cavity resonator is especially advantageous as a cavity resonator in a high power klystron.

According to the present invention, since the coils for making contact are made of heat-resistive materials such as tungsten, degradation of properties during the high temperature exhausting process as is the case with a spring finger system would not occur, and thus stable spring action can be maintained. Still further, since the coil diameter need not be varied in accordance with the size of the cavity as is the case with the prior art shown in FIG. 3*a* in which contact is made by means of a single coil, the present invention has an advantage that the application of the invention is not limited by the size of the cavity but a coil diameter for obtaining an optimum contact pressure suitable for the cavity can be selected, and owing to such advantage, the invention can be applied, with excellent effects, to an internal cavity type of multicavity klystron in which the cavity resonator is located in an evacuated region and is subjected to high temperature baking.

While the coils are provided only along the upper and lower edges of the side plate in FIG. 5, naturally they could be provided along all four edges, i.e. the upper, lower, right and left edges; the spring material is not limited to tungsten, and alternative metals such as molybdenum, stainless steel and the like can also be used; and further, naturally the surface of the metallic wire could be gold-plated, silver-plated or plated with other materials. Although the coil is preferably cylindrical, it may also have an oval or elliptical shape, if desired. Obviously, the grooves provided in edges 9a and 9b would be altered in a similar fashion. The grooves need not be greater than half a circle since the coils will be maintained therein by a pressure fit between the grooves and the cavity interior walls.

What is claimed is:

1. A cavity resonator having an adjustably tunable resonant frequency in which the tuning of the resonant frequency is maintained by means of a movable side plate provided within the hollow cavity resonator housing, characterized in that contactor pieces are supported by at least two opposite edges of said movable side plate whereby the contactor pieces slidably engage the adjacent interior surfaces of the housing to obtain high frequency short-circuiting to the cavity housing;

said contactor pieces being formed of metallic wires wound into coil shape wherein the outer diameters of the coils are each no greater than the distance between the opposed side plate edges in which the coil shape metallic wires are mounted.

2. The cavity resonator of claim 1, wherein the outer diameter of the coil shaped metallic wires is less than the thickness of the side plate.

3. The cavity resonator of claim 1, wherein said side plate edges are each provided with curved grooves for receiving and supporting an associated coil shape metallic wire.

4. The cavity resonator of claim 3, wherein each groove defines a curvature of greater than one-half of a circle.

* * * * *